United States Patent [19]

Webb

[11] 4,269,404

[45] May 26, 1981

[54] SINGLE SHEET FRICTION FEEDER

[75] Inventor: John L. Webb, Fairport, N.Y.

[73] Assignee: Xerox Corporation, Stamford, Conn.

[21] Appl. No.: 27,173

[22] Filed: Apr. 4, 1979

[51] Int. Cl.[3] ..... B65H 3/02

[52] U.S. Cl. ..... 271/42; 271/139

[58] Field of Search ..... 271/42, 139, 140, 137, 271/128, 129, 130, 21, 22, 23, 24, 25, 119; 414/120, 117, 112; 221/259, 232, 244, 266

[56] References Cited

U.S. PATENT DOCUMENTS

| | | | |
|---|---|---|---|
| 615,889 | 12/1898 | Parker | 271/42 |
| 3,383,105 | 5/1968 | Roberts | 271/23 |
| 3,910,567 | 10/1975 | Songer | 271/42 |

*Primary Examiner*—Robert B. Reeves
*Assistant Examiner*—Brian Bond

[57] ABSTRACT

A sheet feeding device (10) that feeds sheets individually from a stack (31) includes a sheet feeding member (20) that strikes the stack (31) at such an acute angle $\theta$ and normal force that the top sheet in the stack is forwarded for subsequent transport while simultaneously retarding movement of the sheet immediately adjacent to the top sheet.

10 Claims, 2 Drawing Figures

SINGLE SHEET FRICTION FEEDER

This invention relates generally to cut sheet feeders and more particularly to a device for feeding individual sheets from a stack to an apparatus such as a copying machine in which the sheets are to be processed further.

Problems, such as misfeeds, multi-feeds and skewing, have been encountered in the past in the various devices that fed sheets from a stack to copiers, low volume terminals and word processors for processing. Numerous attempts at solving the problems have been either extremely involved in construction and, therefore, unusable for simple apparatuses, or do not operate with reliable efficiency.

From the foregoing, a need can be seen for a sheet feeding device that is simple in construction, of low cost in manufacture and reliable in operation.

Accordingly, it is the primary object of the present invention to improve the device that forwards sheets from a stack toward a subsequent processing area.

Various types of devices have been developed before to improve sheet feeders. The following prior art appears relevant:

| Inventor(s) | U.S. Pat. No. | Issue Date |
|---|---|---|
| C. R. Taylor et al. | 3,235,940 | 2/22/66 |
| W. Lehmann | 3,788,638 | 1/29/74 |
| G. Marx et al. | 3,871,641 | 3/18/75 |

Taylor et al. discloses a paper sheet-feed roller than includes a tire assembly made of a urethane polyether foam plastic material.

N. Lehmann describes a roller arrangement used in forwarding sheets that incorporates pairs of rollers that assume a definite and rigid distance from center to center of each other with each roller pair possessing a frictional shell material made from specially prepared foamed polyurethane material.

G. Marx et al. shows a sheet feeding device that employs a foam sheet transport element.

In accordance with the present invention, there is provided a polyurethane foam sheet feeder which provides friction feed of the top sheet from a stack of sheets. The foam feeder in the preferred embodiment strikes the top sheet of the stack at such an acute angle that retarding of the underlying sheet is accomplished also.

Other features of the present invention will become apparent as the following description proceeds and upon reference to the drawings wherein.

Figure 1:
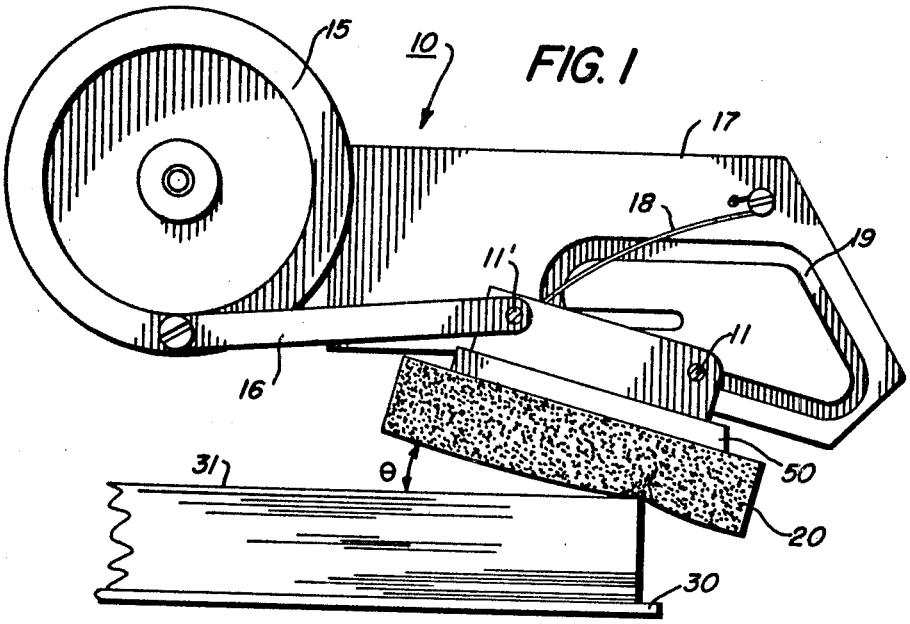
FIG. 1 is a side view of an apparatus incorporating the device of the present invention.

Referring to FIG. 1, there is shown a single sheet feed apparatus 10 that incorporates a foam polyurethane block member 20 for separating a stack of sheets 31 from a stack holder 30. This particular apparatus is uniquely useful in small low volume copiers that use standard sheets of paper and low volume terminals, as well as word processors, since it has few mechanical parts, is cheap to manufacture and is extremely reliable when feeding sheets of standard stock, light weight stock or card stock. In fact, sheet feed apparatus 10 will feed a variety of sheet weights as long as the sheets are flexible.

More specifically, FIG. 1 discloses a drive motor 40 that is mountable in any suitable apparatus that further processes sheets fed from stock holder 30. Motor 40 is connected to drive 100 PPI polyurethane foam block 20 by way of shaft 41 which in turn has drive wheel 15 mounted thereon. Linkage arm 16 is connected to drive wheel 15 and foam separator 20 through block mounting means 50 and 51.

Figure 2:
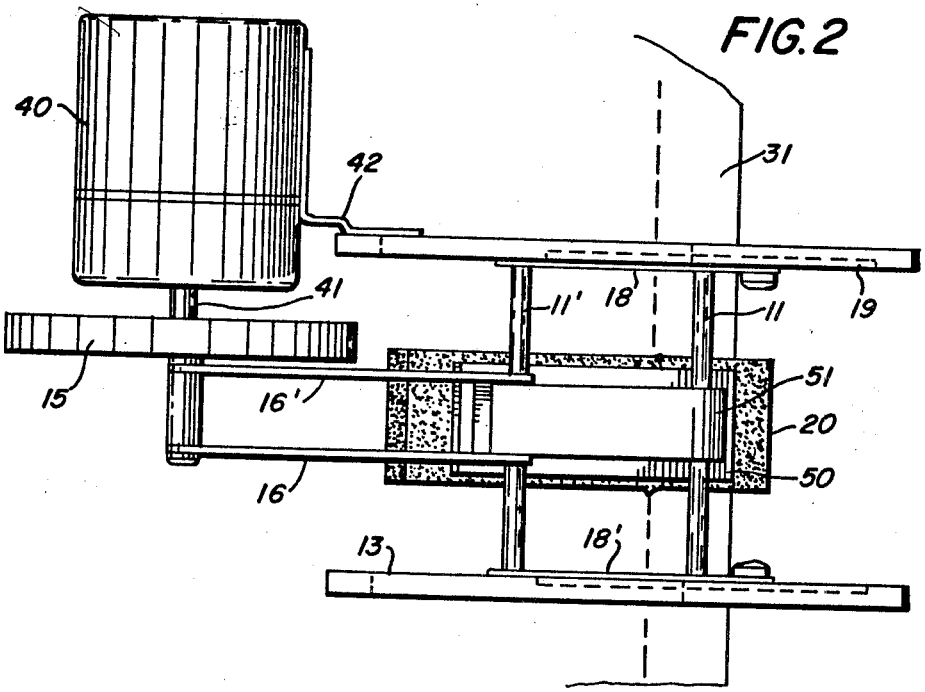
FIG. 2 is a plan view of the apparatus in FIG. 1.

Stationary supports 13 and 17 are mounted on motor 40 through attachment 42. Within support 17 is located a groove or race 19 adapted for traversing by shaft follower 11 which is mounted within block 51. Spring means 18 and 18' are shown in FIG. 2 connected to opposite ends of shaft 11' and are adapted to apply a normal force to foam feed member 20 such that single sheet feeding from stack 31 is enhanced while multi-feeding is simultaneously retarded.

In an aspect of the present invention, the normal force of spring means 18 and 18' applied to feeder means 20 is designed to work in conjunction with the angle of the bottom section of race 19 which is traversed by shaft follower 11 in order to apply only the requisite pressure to feeder means 20 needed to compliment the angle at which the separator member strikes the lead edge of sheet stack 31. This critical angle, normal force and polyurethane foam block feed member accomplishes the feeding of a single sheet from stack 31 while simultaneously retarding the uppermost sheet adjacent the sheet being fed. The critical angle of contact formed between the leading edge of the stack and foam pad 20 is about 10° and the normal force of springs 18 and 18' is about 1 psi. These parameters along with the foam pad being traversed diagonally across the leading edge of the stack of sheets provides a self-snubbing effect and thereby enhances single sheet feeding while simultaneously inhibiting multi-feeding.

It should be understood that while a preferred embodiment of the present invention has been described, single sheet feeder 10 is not limited to that particular embodiment. The feeder will also feed single sheets when the foam member 20 is placed adjacent the front edge of or slightly overlapped with the front edge of stack 30 and in the horizontal plane of sheets 31. Movement of the foam member 20 across the edge of stack 31 while applying a normal force of about 1 psi causes the foam member to conform to and break downward at the stack edge as a single sheet is fed. This conforming to the stacks' edge or deforming of the foam pad transmits a force back against the stack in all instances of feeding that inhibits multi-feeding while the single sheet immediately adjacent the foam member is fed due to the coefficient of friction between the contact surface of the foam member and the top sheet 31 being greater than the coefficient of friction between the top sheet and the sheet immediately adjacent to it. Feeding of a single sheet with the present invention is independent of foam member location. For example, the foam member can be placed to feed from the corner, short side edge or long side edge of stack 31 with satisfactory results.

An advantage of feeder 10 over feeders that include two or more feed rolls is the absence of skew problems. When sheets are fed with foam member 20, they are transported just as they are initially started in the feeding motion without deviation. While foam member 20 is shown in block form, it could be replaced with a foam roll or belt if desired. With either a foam roll, belt or foam block, the latitude of performance can be determined by the type of foam used. Most foams will feed sheets in feeder 10 as long as they will deform and conform to the sheet stack edge during feeding.

In operation of the device shown in FIG. 1, motor 40 is actuated and through shaft 41, as shown in FIG. 2, rotates wheel 15 which in turn translates linkage arm 16 that is connected thereto. Linkage arm 16 is also connected to block mounting means 50 and 51 through shaft 11' and propels follower arm 11 which is also connected to mounting blocks 50 and 51 through enclosed race 19. Polyurethane foam member 20 is approximately 6.5 cm wide and 11.5 cm in length, is attached to mounting block 50, and is moved diagonally across the front edge of sheets 31 as follower arm 11 traverses race 19. As the foam member is moved against the leading edge of the sheets 31, a slight indentation is made in the foam member due to the normal force applied by springs 18 and 18' as each sheet is fed forward. This deformation of the foam member surface causes an impeding force to be applied in the opposite direction of movement against the leading edge of the stack which prevents any sheet but a single top sheet from feeding from the stack and is continued along the stack edge for a major portion of its length until follower arm 11 reaches a point in traversing race 19 that removes the foam member from the stack completely. The area of separator member 20 does not determine whether a single sheet will be fed or not, however, the best results have been obtained with a polyurethane foam separator of block configuration having a length of 11.5 cm and a width of 6.5 cm.

In conclusion, a friction feeder is provided that employs a polyurethane foam sheet separator member. The feeder includes means adapted for moving the separator member diagonally across the leading edge of a stack of sheets and with a requisite normal force such that single sheets are separated from the stack at the same time the sheet immediately below the sheet being fed is self-snubbed.

It is, therefore, evident that there has been provided in accordance with the present invention, a device for forwarding sheets from a stack which fully satisfies the objects, aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. In a sheet feeding device (10) having a stack of sheets (31) and a sheet separator means (20) that includes a frictional surface adjacent the stack of sheets (31) and is capable of being deformed as sheets are fed from the stack (31), the improvement characterized by the feeding device including:

(a) means (18, 18'), for applying a normal force to said separator means (20); and (b) means (11, 16, 19, 40) adapted to move said separator means (20) across the leading edge of stack (31) at an acute angle in relation to the stack (31) in the process of feeding a sheet from the stack (31), said separator means (20) striking the leading edge of the stack (31) at the acute angle and continuing contact with the leading edge of the stack (31) at said acute angle over a major portion of its frictional surface during the feeding process whereby the top sheet of the stack (31) is forwarded for further processing while sheets immediately below the top sheet are simultaneously inhibited from movement by said acute angle movement of the separator.

2. The improvement of claim 1 wherein said normal force is about 1 psi.

3. The improvement of claim 1 wherein said separator means (20) comprises a polyurethane foam material.

4. The improvement of claim 3 wherein said separator means (20) has a length of about 11.5 cm and a width of about 6.5 cm.

5. The improvement of claim 1 wherein said separator means (20) strikes the leading edge of stack (31) at an angle of about 10°.

6. A method of friction feeding sheets individually from a stack of sheets (31) including a sheet separator (20) having a frictional contact surface that is capable of being deformed, characterized by the steps of:

(a) placing said sheet separator (20) adjacent the leading edge of the sheet stack (31);

(b) applying a normal force (18, 18') to said sheet separator;

(c) striking the leading edge of the sheet stack (31) at an acute angle with said separator (20); and (d) continuing movement of said separator (20) at said acute angle for a major portion of its contact surface against the leading edge of the sheet stack (31) whereby the top sheet is fed forward for further processing while the sheets immediately adjacent the top sheet are self-snubbed from movement due to said acute angle movement of said separator (20).

7. The method of claim 6 wherein said normal force (18, 18') is about 1 psi.

8. The method of claim 6 wherein said sheet separator (20) strikes the leading edge of sheet stack (31) at an angle of about 10°.

9. The method of claim 6 including the step of placing said sheet separator (20) so as to overlap the leading edge of sheet stack (31).

10. The method of claims 6, 8 or 9, wherein said sheet separator (20) is comprised of polyurethane foam.

* * * * *